United States Patent [19]

Hyltin

[11] 4,388,563

[45] Jun. 14, 1983

[54] SOLID-STATE FLUORESCENT LAMP BALLAST

[75] Inventor: Tom M. Hyltin, Dallas, Tex.

[73] Assignee: Commodore Electronics, Ltd., Nassau, The Bahamas

[21] Appl. No.: 267,354

[22] Filed: May 26, 1981

[51] Int. Cl.[3] ..... H05B 37/00

[52] U.S. Cl. ..... 315/205; 315/209; 315/226; 315/DIG. 4

[58] Field of Search ..... 315/DIG. 7, 205, 209 R, 315/226, DIG. 4; 307/254, 571

[56] References Cited

U.S. PATENT DOCUMENTS

| | | | |
|---|---|---|---|
| 3,155,875 | 11/1964 | Wenrich et al. | 315/205 |
| 3,525,883 | 8/1970 | Iordanidis | 307/254 |
| 3,753,071 | 8/1973 | Engel et al. | 315/DIG. 7 |
| 3,789,266 | 1/1974 | Polman | 315/DIG. 7 |
| 4,004,188 | 1/1977 | Cooper | 315/DIG. 7 |
| 4,039,862 | 8/1977 | Dingwall et al. | 307/571 |
| 4,075,476 | 2/1978 | Pitel | 315/209 R |
| 4,127,798 | 11/1978 | Anderson | 315/209 R |
| 4,170,747 | 10/1979 | Holmes | 315/205 |
| 4,276,496 | 6/1981 | Arena-Ochoa | 315/209 R |
| 4,277,728 | 7/1981 | Stevens | 315/DIG. 7 |
| 4,323,799 | 4/1982 | King et al. | 307/571 |

*Primary Examiner*—Harold A. Dixon

*Attorney, Agent, or Firm*—Hubbard, Thurman, Turner & Tucker

[57] ABSTRACT

An improved solid-state fluorescent lamp ballast circuit in which rectified line voltage is chopped, utilizing high power field effect transistors, to provide a high frequency input to a fluorescent lamp, thus permitting smaller reactive components to be utilized. Also shown is circuitry whereby the duty cycle of the chopping switches may be modulated to permit dimming of the lamp, which may be remotely located.

12 Claims, 6 Drawing Figures

SOLID-STATE FLUORESCENT LAMP BALLAST

BACKGROUND OF THE INVENTION

This invention relates to fluorescent lamps in general and more particularly to an improved solid-state fluorescent lamp ballast circuit.

Fluorescent lamps are gaseous discharge devices, and therefore typically exhibit a negative resistance characteristic during ionization. Ionization is due to the collision of electrons with the gas molecules contained within the lamp. The more current present in the arc, the lower the effective resistance of the lamp. Generally, a current limiting element must be introduced into the circuitry to prevent the lamp from ultimately destroying itself. The source of electrons for ionization is typically a cathode located in each end of the tube. Fluorescent lamps may be started without cathode preheat by increasing the applied lamp voltage until the free electrons are sufficiently accelerated to produce the energy required to ionize the gas. These voltage requirements are fairly high, dependent upon both the tube type and the operating frequency of the system. However, the starting voltage may be supplied from a reasonably low energy source, such as a high voltage pulse amplifier. Known current limiting and starting ballast functions usually consist of an inductive ballast designed for a particular gaseous discharge tube.

Most known inductive ballasts utilize some type of auto transformer configuration to provide the current limiting reactance and high voltage necessary to cause ionization. The light output, life and starting reliability of a particular fluorescent lamp depend upon the design of the ballast. Therefore, the size, weight and reliability of fluorescent lamp ballasts become very important factors in optimizing the total system efficiency.

Recently, there have been attempts to employ solid-state components for gaseous discharge to ballasts due to the possibility of achieving increased reliability with attendant decreases in the size and weight of such ballasts. Most solid-state ballast circuits utilize some form of semiconductor inverter circuitry to provide a separate frequency source, independent from the sixty cycle line frequency for driving the gaseous discharge to. Various types of semiconductor inverter circuits have been proposed, most of which utilized two or more power switching devices, normally power transistors, and one or more transformers to complete the DC to AC conversion function. One disadvantage of such an approach is the cost and size of the components necessary to provide the large amount of power utilized by known power transistors.

An example of an attempt to employ solid-state components in a ballast circuit for a gaseous discharge lamp may be seen in U.S. Pat. No. 3,896,336, issued to Max. P. Schreiner and Tom M. Hyltin.

SUMMARY OF THE INVENTION

It is therefore an object of this invention to provide an improved solid-state fluorescent lamp ballast circuit.

It is another object of this invention to provide an improved solid-state fluorescent lamp ballast circuit which utilizes switching circuits which require low input currents.

It is yet another object of this invention to provide a dimmable solid-state fluorescent lamp ballast circuit.

It is another object of the invention to provide a dimmable solid-state fluorescent lamp ballast in which the dimming control may be remotely located from the ballast circuit.

The foregoing objects are achieved as is now described. Line voltage is rectified and then chopped to provide a high frequency input to a fluorescent lamp. In a preferred embodiment, the chopping switches are implemented utilizing high power vertical metal oxide semiconductor field effect transistors. In alternate embodiments which utilize non-polar switching devices to implement the chopping switches, the line voltage may be applied directly without rectification. Two of the four chopping switches are controlled utilizing complementary pulse trains. The two remaining chopping switches are controlled utilizing a pulse with modulated pulse trains, thereby controlling the amount of power applied to the fluorescent lamp. In this manner, a fluorescent lamp may be effectively dimmed.

BRIEF DESCRIPTION OF THE DRAWINGS

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
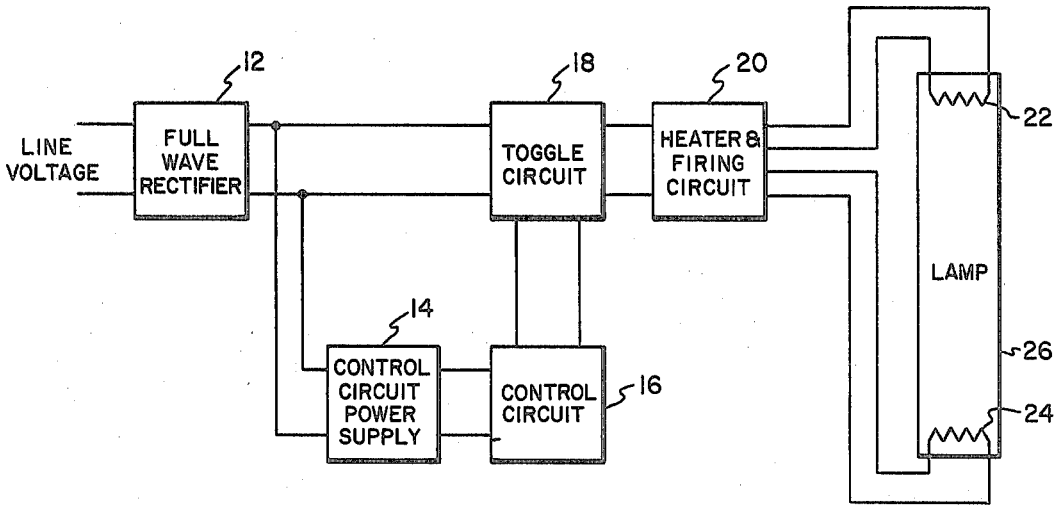
FIG. 1 is a basic block diagram of the solid-state ballast system of the present invention.

With reference now to the Figures, and in particular FIG. 1, there is depicted a basic block diagram of the solid-state lamp ballast system of the present invention.

Line voltage is applied to a full wave rectifier 12 and to control circuit power supply 14. Control circuit power supply 14 may be a power supply of known construction employing rectifiers, filters and voltage regulators, or power supply 14 may simply be an adjunct to full wave rectifier 12.

The output of control circuit power supply 14 is utilized to provide operating voltage to control circuit 16, and the output of full wave rectifier 12 is applied to toggle circuit 18. Toggle circuit 18 may comprise a plurality of switch-type devices capable of controlling the voltages present in such circuitry, and is utilized to "chop" the input voltage at a frequency significantly higher than typical line voltage frequencies. Control circuit 16 will typically include an oscillator circuit which may be utilized to control the operation of the switch-type devices within toggle circuit 18.

The output of toggle circuit 18 is applied to a heater and firing circuit 20, which applies an output to heaters 22 and 24 of fluorescent lamp 26.

Figure 2:
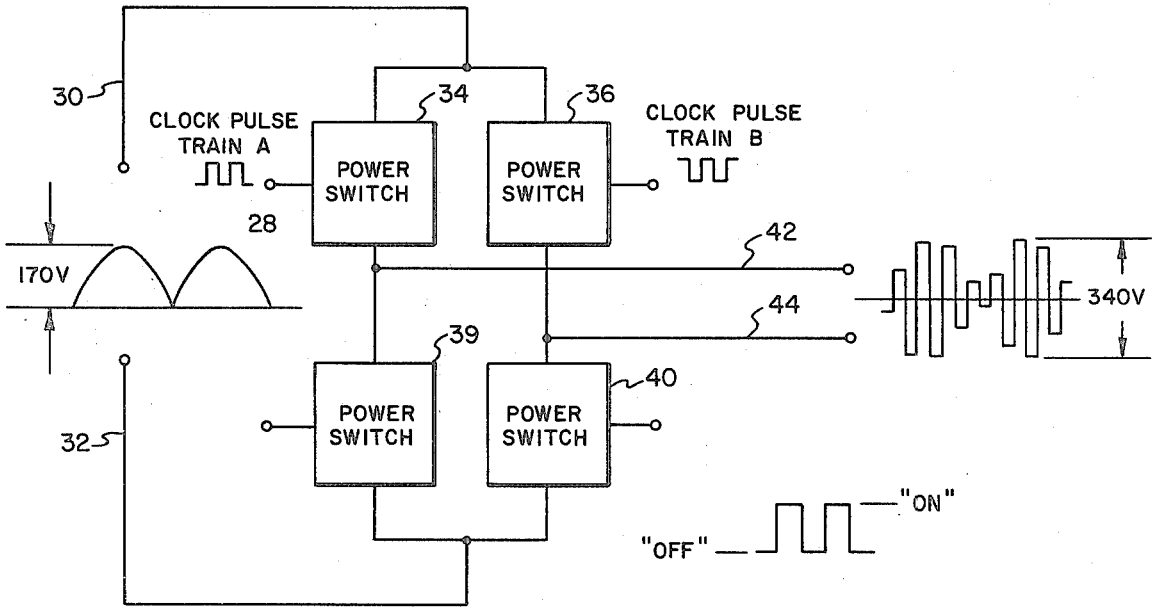
FIG. 2 is a block diagram useful in understanding the operation of the chopping switches of the present invention.

A further understanding of the circuitry of FIG. 1 may be obtained with reference to FIG. 2, wherein a more detailed block diagram of toggle circuit 18 is depicted, along with certain waveforms present in the circuit.

The full wave rectified line voltage 28 is depicted and is applied across input lines 30 and 32. Input lines 30 and 32 apply the voltage wave form 28 to power switches 34, 36, 38 and 40. Each of the power switches depicted may be controlled by the application of a pulse generated by control circuit 16 of FIG. 1.

Control circuit 16 of FIG. 1 develops two types of pulse trains. The first pulse train is utilized to control power switches 34 and 36. Switch 34 and switch 36 are operated by the first pulse train, designated as clock pulse train A, and the complement of pulse train A designated clock pulse train B. In this manner, power switch 34 will conduct and power switch 36 will be open during one-half of the cycle and the reverse will be true during the remaining half cycle.

A second type of pulse train is utilized to control power switches 38 and 40. As with power switches 34 and 36, the pulse train utilized to control power switches 38 and 40 is calculated to ensure that both switches do not conduct simultaneously. Further, it is necessary to ensure that power switch 38 does not conduct simultaneously with power switch 34 and that power switch 40 does not conduct simultaneously with power switch 36, in order to prevent damage to the circuitry.

In actual operation, it is preferable to ensure that power switch 40 conducts only during that period of time that power switch 34 conducts and similarly for power switches 38 and 36. In such cases, the voltage waveform present on output lines 42 and 44 will be as depicted in FIG. 2 the waveform designated 46.

In alternate embodiments, where less power is to be applied to a fluorescent lamp, as when dimming is desired, the pulse trains utilized to control power switches 38 and 40 may be pulsewidth modulated to shorten those periods of time during which power will be available on output lines 42 and 44. The actual circuitry and method of modulating the control pulse train will be explained in greater detail herein.

Figure 3:
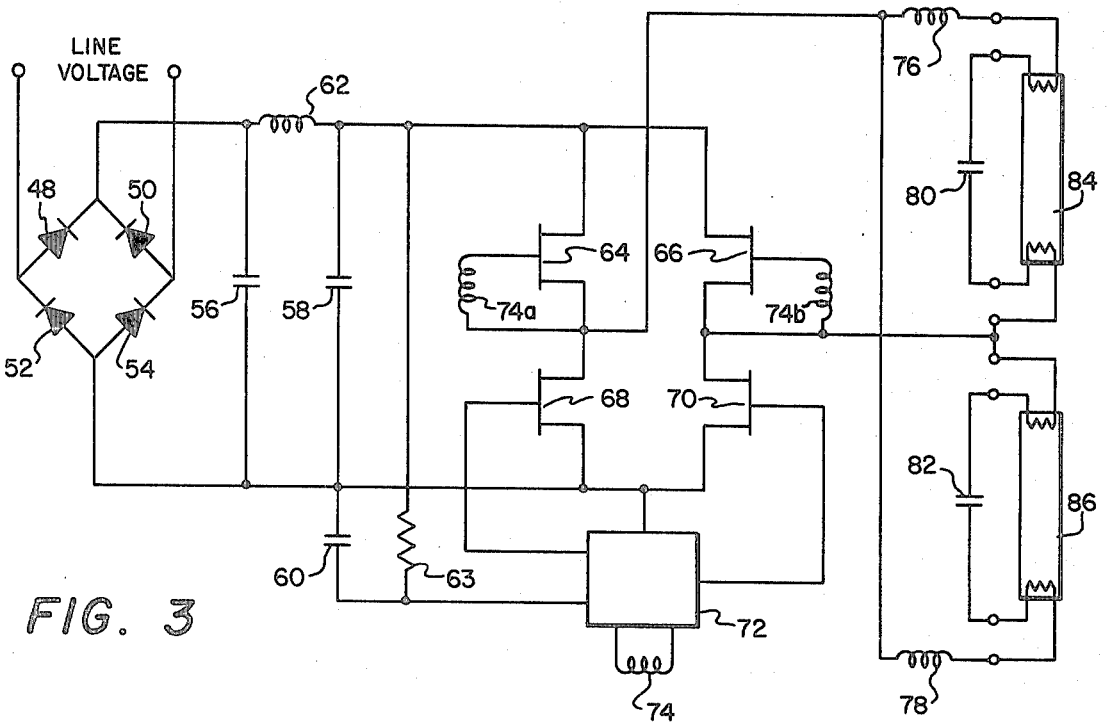
FIG. 3 is a circuit diagram of the solid-state ballast circuit of the present invention.

With reference now to FIG. 3, there is depicted a schematic diagram of the circuitry of the solid-state ballast of the present invention. A diode bridge is formed utilizing diodes 48, 50, 52 and 54. Line voltage is rectified and then applied across switches 64, 66, 68 and 70. The filter formed by inductor 62 and capacitors 56 and 58 is utilized to prevent the high frequency switching signal from coupling back into the line supply voltage.

In a preferred embodiment, switches 64, 66, 68 and 70 are high power vertical MOS type field effect transistors (VMOS). VMOS transistors have significant technical advantages over previously utilized devices. Unlike triacs, silicon controlled rectifiers or gate turn-off devices, VMOS transistors are nonlatching. That is, when the input drive goes to zero volts, the device will reliably turn off. This characteristic is extremely important in view of the disastrous effect which will result if a switch remains closed and thereby shorts out the line voltage supply.

Further, since VMOS transistors are voltage control devices, rather than current driven as most conventional bipolar technology devices are, only a small power supply is necessary to operate the switches.

While VMOS transistors have excellent power handling capabilities, rapid switching and lack many of the power effects which reduce the efficiency of bipolar devices, those skilled in the art will appreciate, however, that certain of the aspects of this invention may be implemented utilizing alternate switching devices. Specifically, switches 64, 66, 68 and 70 may be implemented, in alternate embodiments of the present invention, utilizing triacs, silicon controlled rectifiers, gate controlled switches, regenerative bistable latch type devices, bipolar transistors or Darlington pair transistors, and still derive the benefit of other aspects of the present invention, as disclosed herein.

Referring again to FIG. 3, there is depicted in block form, integrated control circuit 72. Control circuit 72, in a preferred embodiment, may be integrated upon a single semiconductive substrate, utilizing any known process. One version of the circuitry contained within integrated control circuit 72 is depicted in detail within FIG. 4.

Control circuit 72 is utilized to control the operation of switches 64, 66, 68 and 70. It should be apparent to those skilled in the art that power will be applied to both fluorescent lamp 84 and fluorescent lamp 86, during those periods of time that both switch 64 and switch 70 are conducting or those periods that both switch 66 and switch 68 are conducting.

Figure 5:
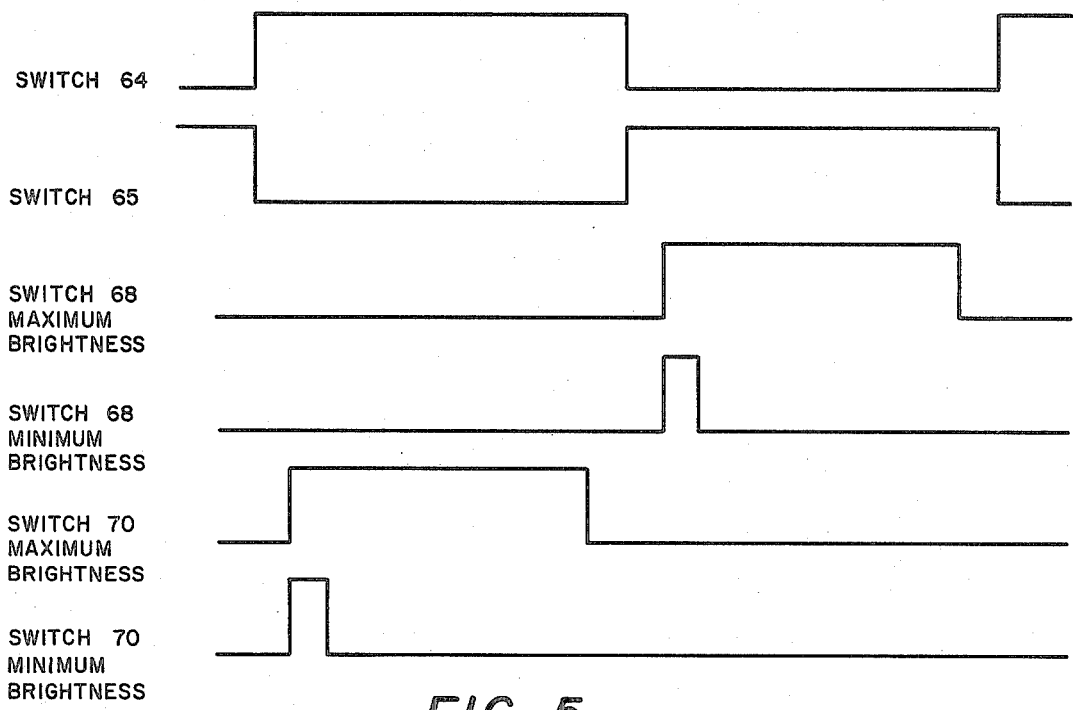
FIG. 5 is a timing diagram associated with FIG. 4.

Referring briefly to FIG. 5, there is depicted a series of voltage waveforms which will aid in an understanding of the circuitry of the present invention. Control circuit 72 will operate switches 64 and 66 by means of transformer primary 74. The individual gates of switches 64 and 66 are each coupled to a separate secondary of transformer 74, labeled **74*a* and 74*b*. Transformer secondaries 74*a* and 74*b* are of opposite polarity, and thus switch 64 will conduct when switch 66 is off and switch 66 will conduct while switch 64 is off. The gate to source voltage waveforms of switches 64 and 66 are depicted in FIG. 5**.

Control circuit 72 controls switches 68 and 70 with a variable duty cycle pulse train as depicted in FIG. 5. Both switches 68 and switch 70 may be turned on for a variable percentage of the time that switch 66 and switch 64 are conducting. Both the maximum and minimum pulsewidths for switches 68 and 70 are depicted in FIG. 5. The maximum pulsewidth utilized to control switches 68 and 70 as depicted, is narrower than the pulsewidth employed to operate switches 64 and 66. This "guard band" on either side of the maximum pulsewidths utilized to control switches 68 and 70 ensures that a short circuit across the rectifier circuit will not occur. By varying the width of the "on" pulse applied to switches 68 and 70, between the minimum and maximum pulse-widths depicted, the amount of power to each lamp, and therefore the amount of brightness of each lamp, may be conveniently varied.

Inductors 76 and 78 and capacitors 80 and 82 form a tuned circuit, at the frequency of the chopped voltage waveform that is ultimately applied to lamps 84 and 86. In a manner well known in the electronics art, these components are utilized to further increase the voltage applied to lamps 84 and 86. It should be appreciated that as a result of the operation of switches 64 and 66 at a sufficiently high frequency, such as ten kilohertz, the reactive components utilized in the depicted circuit may be of substantially smaller values than those utilized with known sixty hertz systems. Further, those skilled in the art will also appreciate that while the circuit depicted in FIG. 3 shows two fluorescent lamps, the advantages of this invention will find application in single lamp circuits, or in circuits which utilize more than two lamps.

Figure 4:
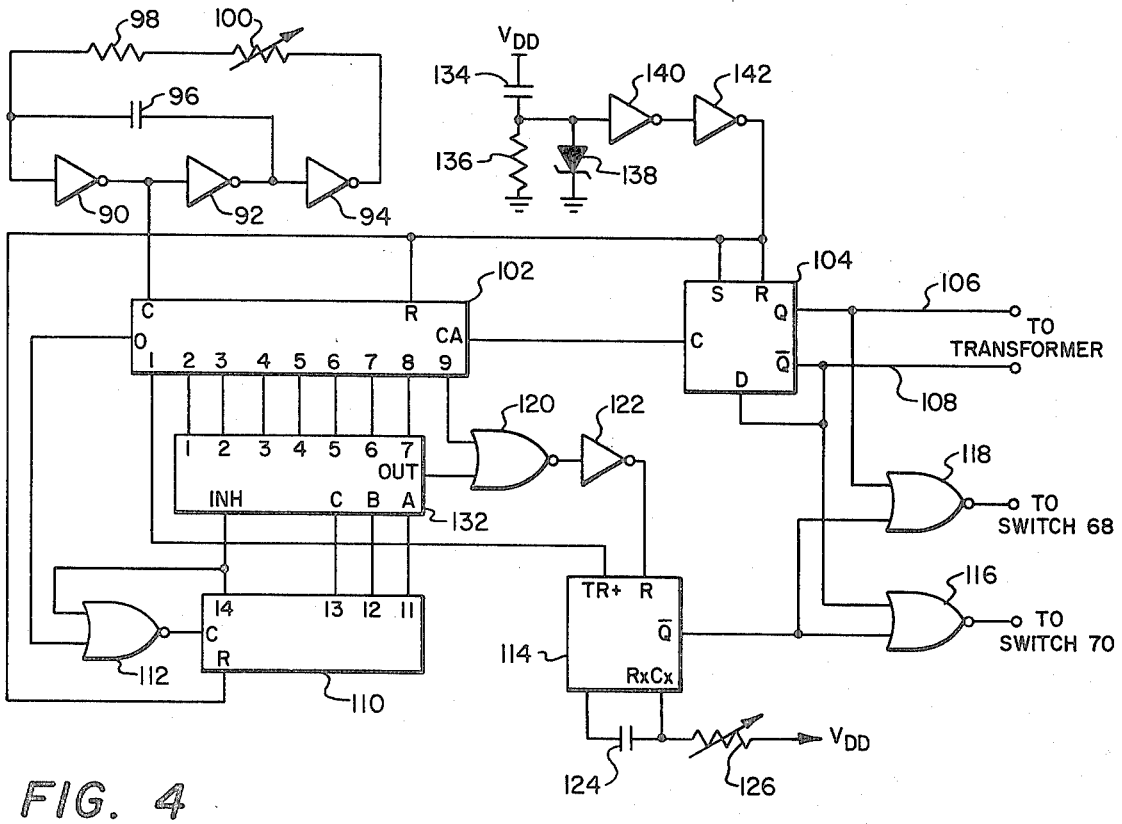
FIG. 4 is a schematic representation of the circuitry within the control integrated circuit of FIG. 3.

Referring now to FIG. 4, there is depicted, utilizing discrete components, the circuitry of integrated control circuit 72 of FIG. 3. While discrete components are utilized for the purpose of explanation, those ordinarily skilled in the art will appreciate that the entire depicted circuit of FIG. 4 may be easily reduced to a single integrated circuit, in view of the state of the art of large scale integration.

A high frequency oscillator circuit is formed utilizing inverters 90, 92 and 94, capacitor 96 and resistors 98 and 100. Resistor 100 is, in a preferred embodiment, a variable resistor which may be utilized to adjust the frequency of the oscillator so formed. In the disclosed embodiment, the values of the depicted components were selected to result in a basic oscillator frequency of approximately 200 kilohertz.

An output of the oscillator circuit, at the output of inverter 90, is applied to counter 102. Counter 102 is a five stage, divide-by-ten Johnson counter with ten decoded outputs and a carry out bit. The carry out bit is coupled to a set/reset flip-flop 104, where it is utilized to change the state of flip-flop 104. Thus, the output of flip-flop 104 will change states every ten cycles of the basic oscillator, and the resultant frequency will be one twentieth of the basic oscillator frequency, or approximately 10 kilohertz.

The output of flip-flop 104, on lines 106 and 108, is applied to transformer primary 74 of FIG. 3, in order to control switches 64 and 68, and provide the pulse train depicted in FIG. 5.

As the input to counter 102 clocks through counter 102, it is utilized in several ways. The "zero" output is applied to counter 110, through gate 112 and is utilized, in a manner explained in detail below, to ensure proper startup upon energization of the lamp circuit.

The "one" output of counter 102 is coupled to the trigger input of monostable multivibrator 114, which is utilized to provide the variable duty cycle pulse train which controls switches 68 and 70 of FIG. 3. The output of monostable multivibrator 114 is applied to gates 116 and 118. The output of monostable multivibrator 114 is NOR'ed with the outputs of flip-flop 104, and will result in a pulse which is coupled to either switch 68 or switch 70. It should be noted that the delay encountered between the "zero" output of counter 102 and the "one" output of counter 102 will serve as the "guard band" previously discussed.

Assuming that no dimming is desired, the status of monostable multivibrator 114 will not change until the pulse present in counter 102 has propagated down to the "nine" output of counter 102. The "nine" output of counter 102 is coupled, via gate 120 and inverter 122, to the reset input of monostable multivibrator 114. Thus, during maximum application of power, a "guard band" will also be present at the end of the pulse applied to switches 68 and 70, due to the delay between the "nine" output and the carry out bit.

The solid-state fluorescent ballast circuit of the present invention may be utilized to dim a fluorescent lamp by varying the duty cycle of the pulse train applied to switches 68 and 70. This is accomplished, in the disclosed embodiment, by resetting monostable multivibrator 114 prior to the coupling of the "nine" output from counter 102. When monostable multivibrator 114 is triggered, capacitor 124 will begin to charge to $V_{DD}$ state, through resistor 126. By varying resistor 126, the RC time constant of the resultant circuit may be adjusted to vary the duty cycle of monostable multivibrator 114. A distinct advantage of the disclosed method of dimming a fluorescent lamp is that resistor 126 may be easily remotely located from the lamp and ballast circuit.

In order to protect the fluorescent lamp circuitry from the deleterious effects of high current, prior to the application of heater current, additional circuitry is utilized during initial start up. The "zero" output of counter 102 is utilized to start counter 110. Counter 110 is a fourteen stage ripple carry binary counter that is utilized to control circuit component 132.

Circuit component 132 is an eight channel analog multiplexer which has three binary control inputs, labelled A, B and C, in FIG. 4. The three control inputs are utilized to select which input will be coupled to the output, through gate 120 and inverter 122, to the next input of flip-flop 114. Thus, as counter 132 counts, changing the signal applied to the control inputs of component 132, the output of counter 102 may be coupled to monostable multivibrator 114 from the "two" output through the "eight" output.

Indeed, by careful selection of the control inputs to component 132, it is possible to ensure that upon initial energization of the lamp circuit, a minimum duty cycle pulse train will be applied to switches 68 and 70, and that the duty cycle will be increased with time, as heater current is applied to each lamp. Additionally, as counter 110 reaches its maximum count, and the "warm up" phase is through, another output of counter 110 may be utilized to inhibit the operation of component 132. At that point, monostable multivibrator 114 will be triggered by the "one" output of counter 102 and reset by the "nine" output, or by the change build-up on capacitor 124, if dimming is desired.

Finally, the circuitry of FIG. 4 may be conveniently initialized utilizing the application of voltage. As $V_{DD}$ is applied to the circuit, the junction of capacitor 134 and resistor 136 will approach $V_{DD}$ (as limited by zener diode 138). This voltage will cause the output of inverter 140 to go "low" and the output of inverter 142 to go "high." The output of inverter 142 is coupled to most of the circuitry of FIG. 4, assuring initialization until the voltage present between capacitor 134 and resistor 136 leaks off, reversing the outputs of inverters 140 and 142, and allowing the circuit to operate.

Figure 6:
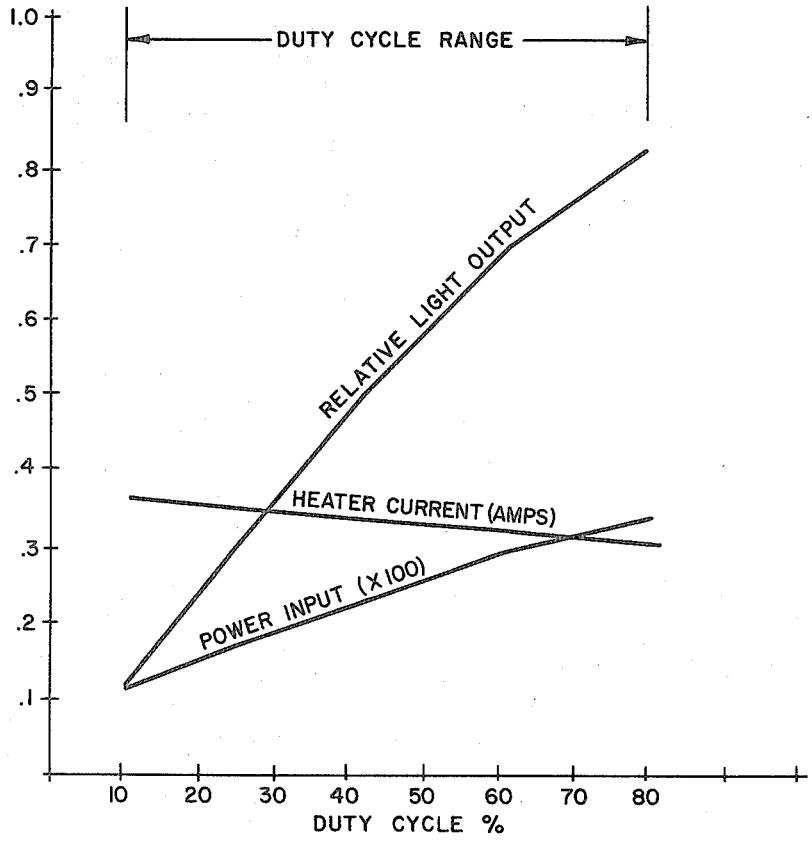
FIG. 6 is an operating diagram relating several operating parameters to the operation of the lamp dimmer circuit of the present invention.

Referring now to FIG. 6, an experimentally derived graph of the operating characteristics of the solid-state lamp ballast circuit of the present invention are depicted. It should be noted that a dimming ratio of eight to one is possible with the disclosed circuit. Further, the heater current rises slightly as the lamp is dimmed. Those skilled in this art will appreciate that this is a desirable feature.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A solid-state dimmable fluorescent lamp ballast circuit comprising:

rectification means for supplying a unipolar electrical voltage;

a first switch adapted to couple a first side of the output of said rectification means to one side of a gaseous discharge lamp;

a second switch adapted to couple said first side of the output of said rectification means to the other side of a gaseous discharge lamp;

a third switch adapted to couple a second side of the output of said rectification means to said one side of a gaseous discharge lamp;

a fourth switch adapted to couple said second side of the output of the said rectification means to said other side of a gaseous discharge lamp;

control means for providing first and second complementary pulse trains and third and fourth variable duty cycle pulse trains, said first pulse train being coupled to said first switch, said second pulse train being coupled to said second switch, said third pulse train being coupled to said third switch and said fourth pulse train being coupled to said fourth switch wherein said fourth switch is closed for a variable percentage of the time said first switch is closed and said third switch is closed for a variable percentage of the time said second switch is closed, said control means comprising:

oscillator means for providing an output having a first frequency;

multiple stage divider means coupled to said oscillator means for providing an output at a second frequency;

first means coupled to the output of said multiple stage divider for providing said first and second pulse trains;

second means selectively coupled to at least one intermediate stage of said multiple stage divider for providing said third and fourth pulse trains; and means for varying the duty cycle of third and fourth pulse trains.

2. The solid-state dimmable fluorescent lamp ballast circuit according to claim 1 wherein said first, second, third and fourth switches comprise metal oxide semiconductor field effect transistors.

3. The solid-state dimmable fluorescent lamp ballast circuit according to claim 1 wherein said first, second, third and fourth switches comprise gate controlled switches.

4. The solid-state dimmable fluorescent lamp ballast circuit according to claim 1 wherein said first, second, third and fourth switches comprise regenerative bistable latch type devices.

5. The solid-state dimmable fluorescent lamp ballast circuit according to claim 1 wherein said first, second, third and fourth switches comprise transistors.

6. The solid-state dimmable fluorescent lamp ballast circuit according to claim 1 wherein each of said first, second, third and fourth switches comprises a Darlington pair of transistors.

7. The solid-state dimmable fluorescent lamp ballast circuit according to claim 1 wherein said first and second switches comprise gate controlled switches and said third and fourth switches comprise transistors.

8. The solid-state dimmable fluorescent lamp ballast circuit according to claim 1 wherein said first and second switches comprise regenerative bistable latch type devices and said third and fourth switches comprise transistors.

9. The solid state dimmable fluorescent lamp ballast circuit according to claim 1 wherein said rectification means comprises a full wave rectifier.

10. The solid-state dimmable fluorescent lamp ballast circuit according to claim 1 further including reactive means coupling said switches and said gaseous discharge lamp.

11. The solid-state dimmable fluorescent lamp ballast circuit according to claim 10 wherein said reactive means comprises an inductor selected to limit current flow into said gaseous discharge lamp and further includes a capacitor shunted across said gaseous discharge lamp, said capacitor selected to form a tuned circuit with said inductor.

12. The solid-state dimmable fluorescent lamp ballast circuit according to claim 1 wherein said means for varying the duty cycle of said third and fourth pulse trains is located remotely from said first, second, third and fourth switches.

* * * * *